United States Patent [19]

Cross, Jr.

[11] Patent Number: 4,843,732

[45] Date of Patent: Jul. 4, 1989

[54] VIBRATORY AND GAS LEVITATION PARTICLE TREATMENT SYSTEM

[75] Inventor: Wiley E. Cross, Jr., Glen Allen, Va.

[73] Assignee: The Cardwell Machine Company, Richmond, Va.

[21] Appl. No.: 139,183

[22] Filed: Dec. 29, 1987

[51] Int. Cl.[4] ..... F26B 17/24

[52] U.S. Cl. ..... 34/57 A; 34/10; 34/164

[58] Field of Search ..... 34/57 R, 57 A, 57 B, 34/10, 164

[56] References Cited

U.S. PATENT DOCUMENTS 750,262 1/1904 Cooley ..... 34/164

4,090,852 5/1978 Dowd ..... 34/57 A

*Primary Examiner*—Henry A. Bennett

*Attorney, Agent, or Firm*—John F. C. Glenn

[57] ABSTRACT

Spaced overlapping louver panels on a vibratory horizontal deck levitate and convey particles moving across the deck as they are dried or otherwise treated by gas blown between the panels. The panels have flanges where they overlap, and flat central areas sloping upwardly in the direction of particle flow. Multiple superimposed decks can be used with the particles on them moving horizontally in alternating directions.

11 Claims, 5 Drawing Sheets

VIBRATORY AND GAS LEVITATION PARTICLE TREATMENT SYSTEM

BACKGROUND OF THE INVENTION

Particles have long been treated for various purposes in streams conveyed over louver decks through which gas is blown upwardly to levitate and treat the particles while the decks are vibrated to advance the particles.

In the case of particle dryers, satisfactory addition or removal of moisture and heat from particles of various materials is governed by a number of factors, such as absorption or release characteristics of the material, relative differences in temperature between the gas and the material, relative mass flows of gas and material, their specific heats and specific volumes, and other constraints, such as temperature limits. These values are approximately the same for any drying device.

Use of vibrating action in conjunction with gas blowing is a well-known technology for particle drying, and several types have been employed commercially. One type uses a vibrating pan to convey the material, while a series of vertical tubes extend down into the material and the drying gases blown through the open bottoms of the tubes and thence into the layer of material. Others direct the drying gas upwards through perforations across the area of a vibrating plate. It is also known to counterbalance the vibrations by using four horizontal decks and phasing their respective vibrations suitably for that purpose. Such counterbalancing requires that all four decks be parallel to each other, and also horizontal if the flow is to be in successive opposite directions as the particles pass from one deck to the next.

When perforated plates are used the openings are exposed and contact the particles with each oscillation of the perforated plate. Particles smaller than the openings fall through the openings into the plenum. Particles of a size near that of the openings become wedged in the openings, which retards the flow of drying gas. These wedged particles also act to retard the flow of material over the perforated plate. There is also a tendency for particles of varying sizes to seek different levels in the mass of airborne particles, so that the particles get varying exposures to the drying air or other gas treatment.

The use of louvers as an alternative to perforations has been known for particle treating purposes. In that case, protective downwardly extending flanges are desirable for purposes of gas flow control and also to oppose entry of particles into the louver openings. However, the downward extent of the flanges would require a compensating upward slope of the main area of the panels if the deck is to be horizontal. This has evidently been considered impractical without returning to perforation of the panels (as shown in Ostberg U.S. Pat. No. 3,089,688 issued May 14, 1963), or else accepting a downward slope of the the deck as a whole (as shown in Cooley U.S. Pat. No. 750,262 issued Jan. 26, 1904).

SUMMARY OF THE INVENTION

In accordance with the present invention, a louver deck is vibrated to urge particles to move across the tops of a series of overlapping panels extending across the deck, while air or other gas is blown through gaps between adjacent panels, where a downwardly extending flange of one adjacent panel is spaced from an opposite overlapped upper surface of the other adjacent panel. Central portions of the panels are sloped upwardly to offset the projection and spacing of the downward flanges, and also to give an upward component of motion of the air emitted beneath the downwardly extending flanges. The upward component aids in increasing fluidization and turbulent mixing of the stream of particles passing over the panels, thus reducing the dwell time necessary for drying, heating or other treatment effects.

Forward movement of the particles is largely effected through vibration of the panels, an effect which is aided by the pushing effect of the downward flanges.

The panels are of unperforated sheet metal which is stiffened where overlapped by an upturned flange which extends parallel to and spaced from the downturned flange from the adjacent panel. Air under pressure is conveyed over the top of the upturned flange, down the slot between the upturned and downturned flanges, and out beneath the bottom edge of the downturned flange.

Other objects, advantages and details of the invention will become apparent as the following disclosure of the present preferred embodiment proceeds.

BRIEF DESCRIPTION OF THE DRAWINGS

The accompanying drawings schemtically illustrate present preferred embodiment of the apparatus of the invention. In the drawings.

DETAILED DESCRIPTION OF PRESENT PREFERRED EMBODIMENT OF THE INVENTION

Figure 1:
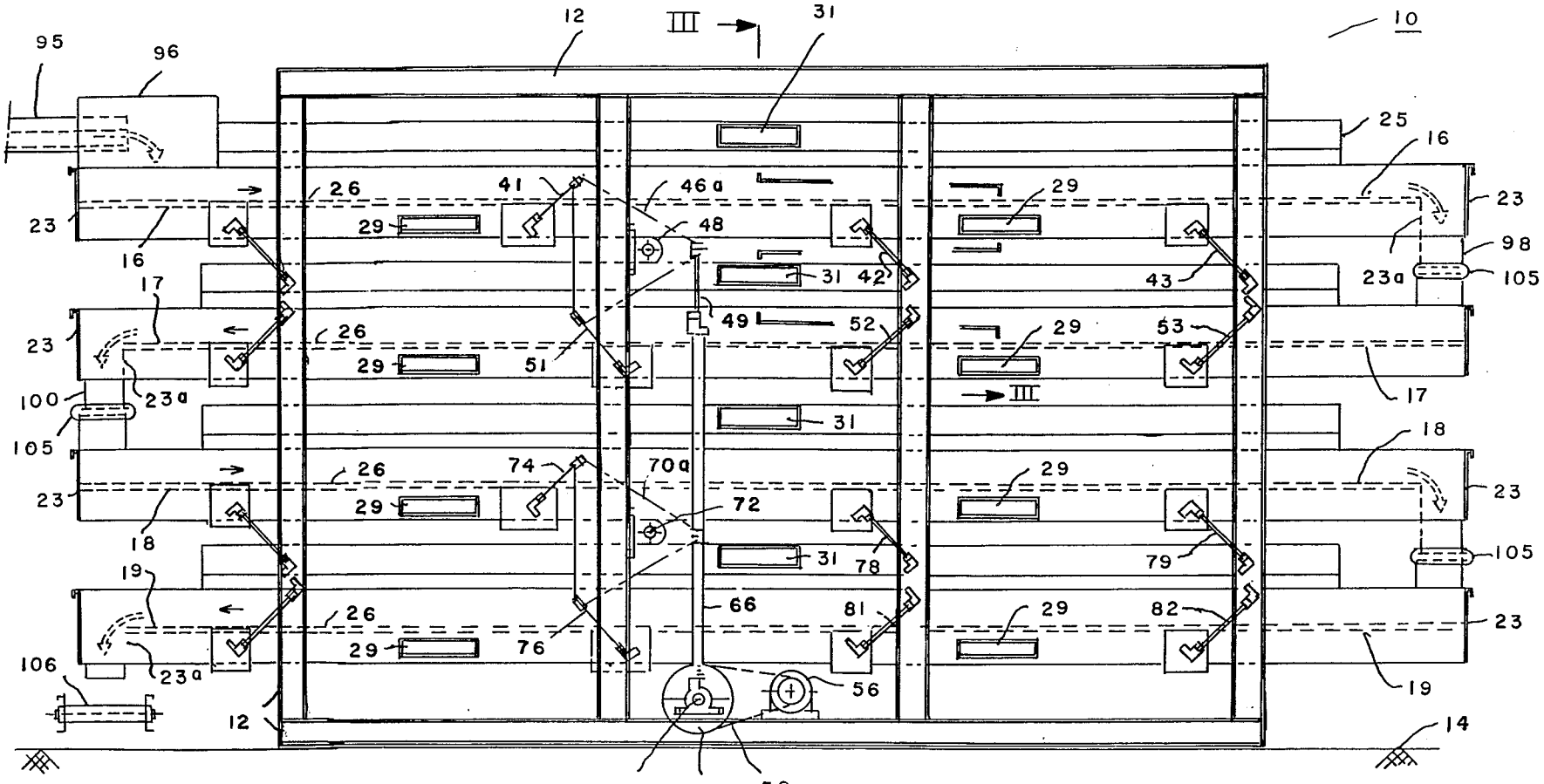
FIG. 1 shows a side view of apparatus of the invention.
Figure 2:
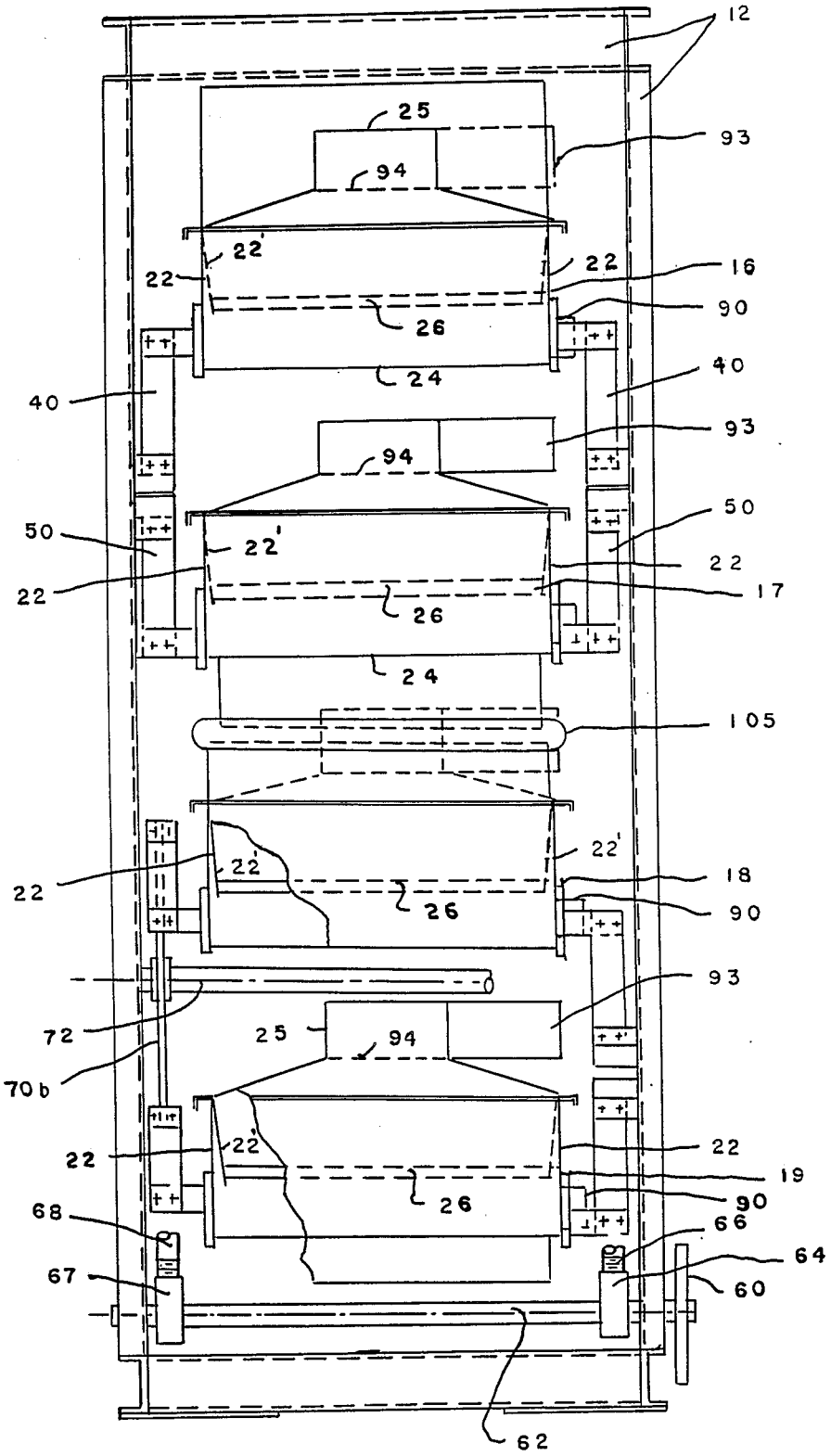
FIG. 2 shows an enlarged end view from the left of FIG. 1, partially broken away and omitting the end feed and discharge chutes.
Figure 3:
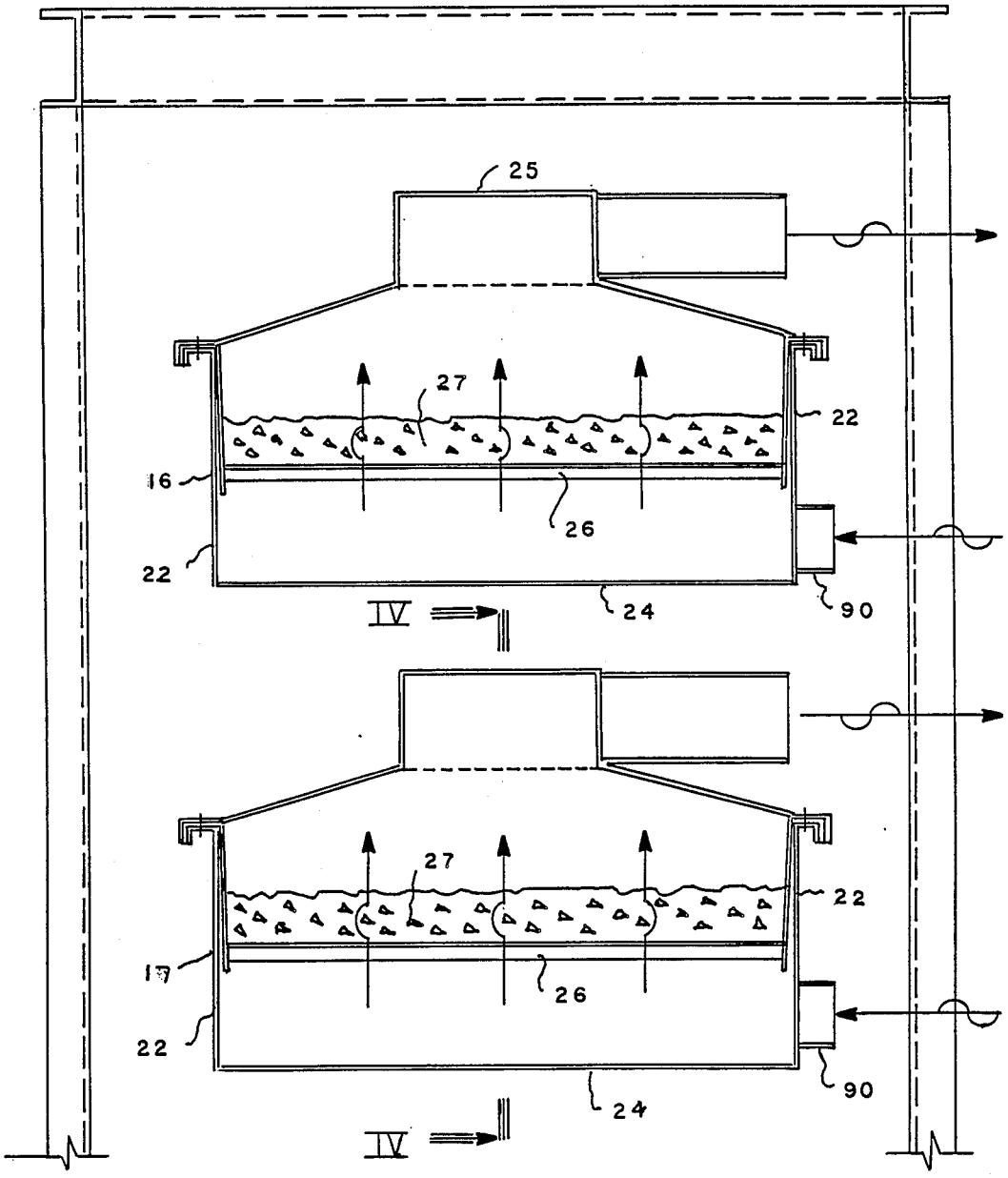
FIG. 3 shows a further enlarged and partially broken away view of a section through the broken line III—III in FIG. 1.

Turning now more particularly to the accompanying drawings, an air drying or other gas treating apparatus 10 has an external frame 12 resting on a floor 14. Four horizontal decks 16, 17, 18 and 19 are vertically stacked in spaced relation within the frame.

Each deck has a pair of side walls 22 and a pair of

Each deck has a pair of side walls 22 and a pair of end walls 23 (which can swing outwardly for convenient access). The space within these walls is enclosed at the bottom by a cover piece 24 secured to the lower ends of walls 22 and 23, and at the top by a hood 25 secure to the tops of walls 22 and 23.

A series of rectangular metal panels 26 extend between and are secured to the sides of a tray 22' nested within the upper portions of the walls 22 and 23 of each deck, so that the ends of the panels are secured next to and functionaly integral with the side walls 22 of the deck. The panels 26 of each deck extend from its end wall 23 at the inlet end of the deck almost to its end wall 23 at the outlet end of the deck, where a space is left for discharge of particles 27 passing over the panels 26 from the inlet to the outlet ends of the deck. A supplemental end wall **23*a* is spaced inwardly from the end wall 23 at the outlet end of each deck, to provide an outlet chute for the particles and to seal off theair enclosed beneath panels 26 from air in the chute. Each deck has air inlets 29 through one of its side walls 22 beneath its panels 26, and an air outlet 31 through its hood 25 above its panels 26. Air supplied under pressure through air inlets 29, of each deck is so confined that it can reach the deck's air outlet 31 only by passing through the deck's panels 26 (see FIG. 4, which is most easily understood by reference to decks 16 or 18 as shown in FIG. 1, although FIG. 4 actually shows deck 17 as viewed from the reverse side of FIG. 1** in order to achieve a like left-to-right motion).

A few of the panels of each deck may be arranged in a downwardly sloping series from the end wall 23 at the inlet end of the deck to the place where particles 27 are initially fed onto the deck. However, this is not essential, and all of the panels 26 of each deck may extend horizontally from one end of the deck to the other like the series of panels 26*a*, -*b* and -*c* shown in FIGS. 4 and 5. The flat rectangular central portions 28*a*, -*b* and -*c* of these panels are bounded respectively along their longer opposite sides by upturned flanges 30*a*, -*b* and -*c* on one side and downturned flanges 32*a*, -*b* and -*c* on the other side. Both sets of flanges run between the side members 22 of the deck. The downturned flange 32*a* of panel 26*a* overlaps the upturned flange 30*b* and adjacent part of the central portion 28*b* of the next panel 26*b*, and the downturned flange 32*b* of panel 26*b* overlaps the upturned flange 30*c* and adjacent part of the central portion 28*c* of panel 26*c*. The flanges 32*a* and 30*b* extend parallel to each other and are spaced from each other by a distance less than the length of the projection of each of the flanges from the outside corner at its base. The lowermost edges 32*a*' and 32*b*' of the respective flanges 32*a* and 32*b* are each spaced from the respective opposite top surfaces of the central portions 28*b* and -*c* of adjacent panels 26*a* and -*b* a distance no less than the spacing between flanges 30*b* and 32*a* and between flanges 30*c* and 32*b*. This arrangement creates paths for air under pressure beneath the panels 26*a*, -*b* and -*c* to pass between the panels. For example, it can pass around the space between the top edge 30*b*' of upwardly extending flange 30*b* and the opposite bottom surface of central panel portion 28*a* (which is not less than the spacing between downwardly extending flange 32*a* and opposite upper surface of central panel portion 28*b*), thence down the slot between flanges 30*b* and 32*a*, and thence out between the lower edge of downwardly extending flange 32*a* and the opposite top surface of central panel portion 28*b*. The combination of the last mentioned edge and flat surface tends to blow the air outwardly along the flat surface but with an upwardly swirling movement which is capable of levitating and thereby at least semi-fluidizing in air a stream of particles passing from the top of panel 26*a* across the top of panel 26*b*. The rest of the panels 26 are correspondingly flanged and overlapped where they are adjacent to each other.

The panels of each deck are mounted with their portions between their flanges sloping upwardly toward their downturned flanges when the deck is aligned horizontally. One effect of the upward slope of the central portions of the panels is to add an upward component of movement to the air emerging between adjacent panels. The amount of upward slope for purposes of the invention is in the range of about 10° to 20°. A smaller slope would preclude downwardly extending flanges of adequate projection while still retaining horizontal alignment of the decks. A larger degree of slope would increase the hill and valley effect of the successive panels to such an extent as to interfere with the desired flow and fluidization of the particles.

The angle of the flanges to the central portions of the panels (preferably perpendicular) causes the flanges to be sloped toward rather than away from the direction of particle flow. This is convenient from the point of view of manufacture and operationally suitable for purposes of the invention.

Figure 4:
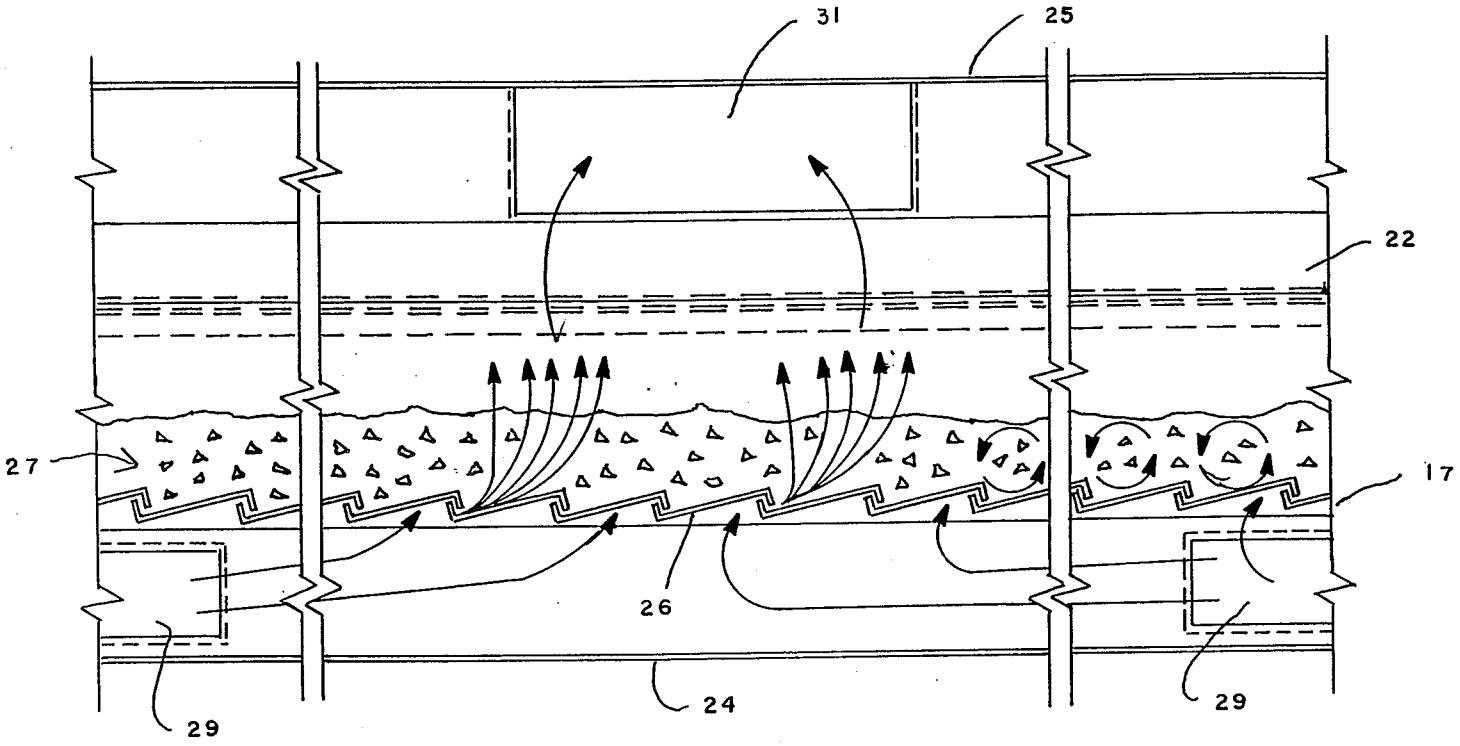
FIG. 4 shows a further enlarged and partially broken away section on the line IV—IV in FIG. 3.
Figure 5:
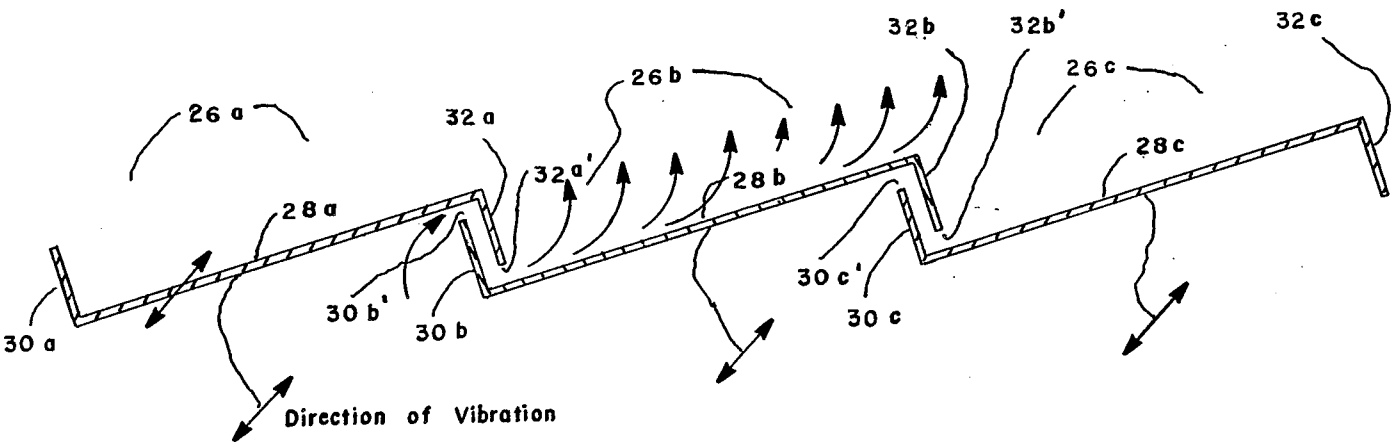
FIG. 5 shows a further enlarged view of a series of the louver panels shown in FIG. 4.

The decks 16–19 are each vibrated in a manner which advances particles across the top of the central portion of each panel toward the upper end of its downward flange (to the right as shown in FIGS. 4 and 5). For that purpose the top deck 16 is supported by four pairs of elongated leaf springs 40–43 having ends connected to deck side walls 22 on opposite sides of the deck and all extending at an angle to the horizontal when the decks are horizontal. For most purposes an angle of 45° is preferred, but it can be increased or decreased for longer or shorter retention time. The pair of springs 40 and the pair of springs 43 are connected to opposite ends of the deck 16, and the pair of springs 42 are connected to deck 16 about one-third of its length inwardly of the connec tion to the pair of springs 43. All of the pairs of springs 40, 42 and 43 extend downwardly from the deck to the right as seen in FIG. 1 and are connected at verticle members of frame 12. The remaining pair of springs 41 extend upwardly from deck 16 to the right as shown in FIG. 1 and are connected at their upper ends to corresponding corners of a pair of triangular rocker plates 46*a* and 46*b* keyed on a shaft 48 journaled in bearings supported by frame 12. When plates 46*a* and -*b* rock clockwise a short distance they pull springs 41 diagonally upward along a small segment of an arch extending diagonally upward to the right as shown in FIG. 1 at an angle of about 45° to the horizontal. When plates 46*a* and -*b* are rocked counterclockwise back again they move springs 41 back again in the opposite direction. During these movements of springs 41 the other springs 40, 42 and 43 respond in a manner causing deck 16 to move, while remaining horizontal, diagonally upward and to the right as shown in FIG. 1 and back again in the opposite direction. During this diagonal upward movement of deck 16 the particles resting on it are urged upward and forward by panels 26, and during the return movement the particles thereon are not pressed against the panels and are restrained by their own inertia from moving back again in the opposite direction. As a result, there is a net forward impetus given to the particles by the said vibratory motion of deck 16.

The next deck 17 is supported by four sets of leaf springs 50–53 having ends connected to the side members 22 of the deck and all extending at 45° to the horizontal. Springs 50, 52 and 53 extend upwardly to the right as seen in FIG. 1 and are connected at their upper ends to frame 12 and at their lower ends to side members 22 on opposite sides of deck 17. The pair of springs 51 extend downwardly to the right as shown in FIG. 1, and are connected at their upper ends to corresponding additional corners of rocker plates 46*a* and -*b*, and at their lower ends to side members 22 on opposite sides of deck 17. The earlier described clockwise and counterclockwise rocking movements of plates 46*a* and -*b* cause the springs 50–52 to reciprocate deck 17 in phase with deck 16 but diagonally upwardly to the left when deck 16 is moving diagonally downwardly to the right, and vice versa, and in a direction of reciprocation at right angles to the direction of reciprocation of deck 16.

A motor 56 drives a belt 58 and pulley 60 keyed on a shaft 62 which is journaled on frame 12 and connected to turn an eccentric 64 journaled in the lower end of a vertical push rod 66. A third corner of rocker plate 46*a* is connected through a spring 49 to the top of push rod 66 so that motor 56 powers push rod 66 to reciprocate rocker plate 46*a* and through shaft 48 to correpondingly reciprocate rocker plate 46*b*.

Shaft 62 extends across frame 12 to drive another eccentric 67 to reciprocate another vertical push rod 68 connected to a corner of a rocker plate 70*a* keyed to a shaft 72 journaled on frame 12. Shaft 72 goes across frame 12 and at its other end is keyed to a rocker plate 70*b*.

Rocker plates 70*a* and -*b* have corresponding corners connected to a pair of leaf springs 74, and another pair of corresponding corners connected to a pair of leaf springs 76. Springs 74 are connected to deck 18 in the same manner as springs 41 to deck 16, and springs 76 are connected to deck 19 in the same manner as springs 51 to deck 17. Deck 18 is supported on three pairs of springs 77–79 in the same manner as deck 16 is supported on springs 41, 42 and 43. Deck 19 is supported on three pairs of springs 80–82 in the same manner as deck 17 on springs 50, 52 and 53.

Reciprocation of rocker plates of 70*a* and -*b* reciprocates decks 18 and 19 in the same manner as rocker plates 46*a* and -*b* reciprocates decks 16 and 17. However, the eccentric 64 which reciprocates push rod 66 is offset 180 degrees from the eccentric 67 which drives push rod 68, in order to counterbalance deck 16 against 19, and deck 17 against 18, thereby avoiding need for counterweights to minimize vibration transmitted to the floor while all four decks are operating.

An air plenum chamber 86 extends beneath the panels 26 of deck 16, formed by walls 22, 24 and 23*a* and bottom cover 24. Hood 25 extends over deck 16 to collect the air passing through these panels from chamber 86. A separate plenum chamber and separate hood are similarly provided for each of the other decks 17–19. Air or other treating gas at a desired pressure, temperature, humidity or other condition is forced into each of these plenum chambers from separate conduits 90 connecting their inlets 29 to a common fan-driven source (not shown). After passing through the panels and into the hood of each deck, the gas is drawn from the hoods through outlet conduits 93 connecting their outlets 31 to a common fan-driven exhaust unit (not shown). A screen 94 is preferably mounted in each hood between the panels and outlet conduit to catch fines blown up by the treating gas.

Particles 27 are fed on to the top of one end of deck 16 through a feed conveyor 95 and entry hood 96, and at the other end of deck 16 are dropped through a chute 98 onto the end therebeneath of deck 17. The particles are conveyed to the other end of deck 17, dropped through a like chute 100 onto an end of deck 18, conveyed to the other end of deck 18 dropped through a chute 102 onto deck 19, and conveyed by deck 19 to an exit chute 104 for deposit onto a belt conveyor 106. Flexible connections 105 in the chutes accomodate differences of motion of the decks. The successive decks thus convey in opposite directions (decks 16 and 18 to the right and decks 17 and 19 to the left as shown in FIG. 1), so there is no space needed between them for supplemental return conveyor belts.

While a present preferred embodiment of the invention has been illustrated and described, it will be understood that the invention may be otherwise embodied and practiced within the scope of the following claims.

I claim:

1. Apparatus for treating a moving layer of particles with a gas, comprising an elongated and substantially horizontal conveyor deck having an inlet for particles at one end and an outlet for particles at the other end, and including a series of panels mounted on the deck in succession between its inlet and outlet ends, means to vibrate the deck and panels in a manner which urges particles on the panels to move from the inlet to the outlet end of the deck while the deck remains horizontal during vibration, substantially all of the intermediate panels each having a substantially flat central portion sloping upwardly in the direction of the outlet end of the deck, and each having a flange projecting downwardly from the top of the slope toward and overlapping an opposite upper surface of the central portion of an adjacent panel, said flange having its lowermost portions spaced from said opposite surface to form an opening therebetween, means to supply gas under pressure beneath the panels, and means enclosing the panels to cause substantially all of said gas under pressure to pass through said openings between adjacent panels.

2. Apparatus according to claim 1, comprising means mounting the deck to extend horizontally between its inlet and outlet ends.

3. Apparatus according to claim 1, in which the downwardly extending flange has a downward projection greater than its spacing from said opposite upper surface of the adjacent panel.

4. Apparatus according to claim 1, in which a panel overlapped by said downwardly extending flange of another panel has an upwardly extending flange which is spaced from and substantially parallel to said downwardly extending flange and is beneath and spaced from the flat central portion of the overlapping panel.

5. Apparatus according to claim 4, in which said upwardly extending flange has an upward projection greater than its closest spacing from the flat central portion of the overlapping panel and greater than the closest spacing between said downwardly extending flange and the opposite flat central portion of the overlapped panel.

6. Apparatus according the claim 1, in which the slope of the central portions of the panels is in the range of ten to twenty degrees from horizontal.

7. Apparatus for treating a moving layer of particles with a gas, comprising a group of four elongated conveyor decks each extending horizontally and having an inlet for particles at one end and an outlet for particles at the other end, said decks being stacked in spaced parallel relation and arranged so that the inlet and outlet ends are reversed in successive decks, each deck including a series of panels mounted on the deck in succession between its inlet and outlet ends, means to vibrate the decks and panels in a manner which urges particles on the panels of each deck to move from the inlet to the outlet end of the deck while the deck remains horizontal during vibration, substantially all of said panels of each deck having a substantially flat central portion sloping upwardly in the direction of the outlet end of the deck, and the intermediate panels of each deck each having a flange projecting downwardly from the top of the slope toward and overlapping an opposite upper surface of the central portion of an adjacent panel, and each downwardly projecting flange having its lowermost portion spaced from said opposite surface to form an opening therebetween, means to supply gas under pressure beneath the panels of each deck, and means enclosing the panels of each deck to cause substantially all of said gas under pressure beneath the panel to pass through said openings between adjacent panels.

8. Apparatus according to claim 7, comprising means above each deck for conveying away gas which has passed between the panels of the deck.

9. Apparatus according to claim 8, comprising means to coordinate the respective deck vibrating means so that the vibrations of the respective decks tend to offset each other.

10. Apparatus according to claim 7, in which the slope of the central portions of the central portions of the panels is in the range of ten to twenty degree from the horizontal.

11. Apparatus for treating a moving layer of particles with a gas, comprising an elongated and substantially horizontally extending conveyor deck having an inlet for particles at one end and an outlet for particles at the other end, and including a series of panels mounted on the deck in sucession between its inlet and outlet ends, means to vibrate the deck and panels in a manner which urges particles on the panels to move from the inlet to the outlet end of the deck while the deck remains horizontal during vibration, substantially all of the intermediate panels each having a substantially flat central protion sloping upwardly in the direction of the outlet end of the deck, each having a flange projecting upwardly from the bottom of the slope toward, spaced from and overlapped by an adjacent lower surface of the central portion of the next preceding panel in the series, and each having a flange projecting downwardly from the top of the slope toward, spaced from and overlapping an opposite upper surface of the central portion of the next following panel in the series and also spaced from, overlapping and substantially parallel to the adjacent upwardly projecting flange of the preceding panel in the series, means to supply gas under pressure beneath the panels, and means enclosing the panels to cause substantially all of said gas under pressure to pass between adjacent oppositely projecting flanges and thence outwardly between the downwardly projecting flanges and the opposite upwardly sloping top surfaces of the central portions of the intermediate panels.

* * * * *